United States Patent [19]

Tesler

[11] Patent Number: 4,688,571

[45] Date of Patent: Aug. 25, 1987

[54] ONE-PIECE LUMINOUS PACIFIER

[76] Inventor: Yosef G. Tesler, 709 N. Lake Dr., Lakewood, N.J. 08701

[21] Appl. No.: 874,615

[22] Filed: Jun. 16, 1986

[51] Int. Cl.[4] ..... A61J 17/00
[52] U.S. Cl. ..... 128/360
[58] Field of Search ..... 128/359, 360

[56] References Cited

U.S. PATENT DOCUMENTS 3,186,411 6/1965 Skidmore ..... 128/360

*Primary Examiner*—Dalton L. Truluck

[57] ABSTRACT

A luminous pacifier includes a non-luminous nipple formed on, or wedged against, a non-luminous surface of a shield and a luminous ring formed on the other surface of the shield whereby the shield prevents direct contact between a person sucking on the nipple and the luminous ring.

3 Claims, 5 Drawing Figures

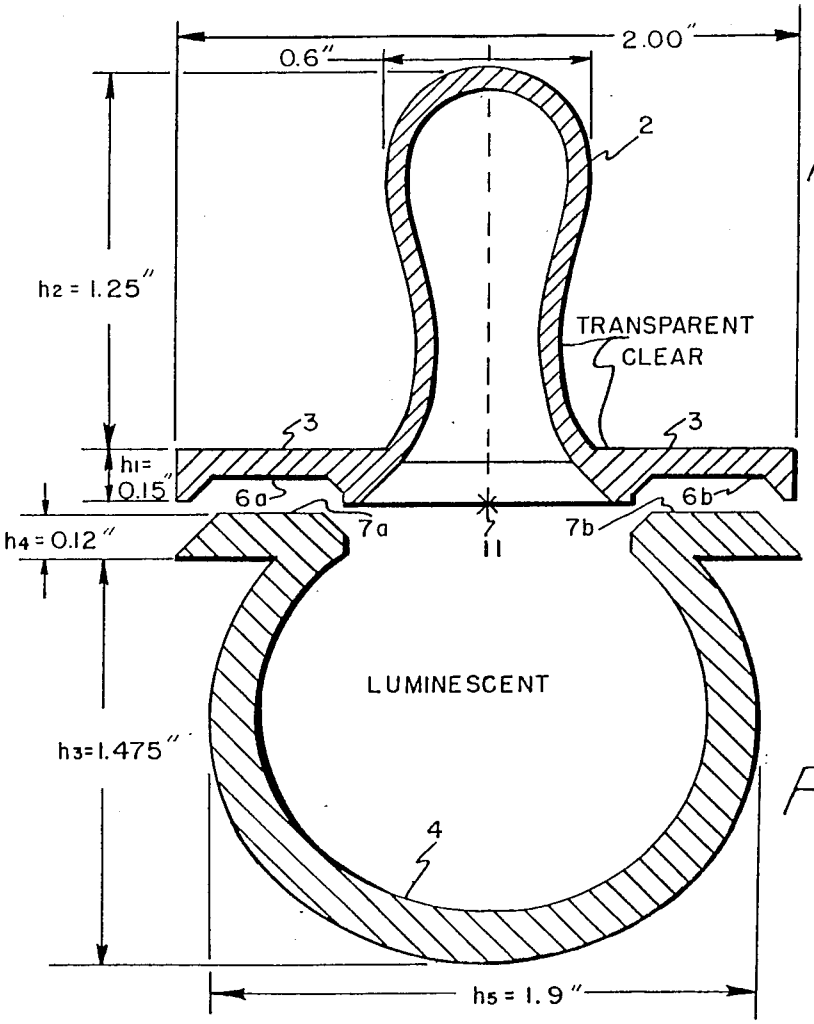
Fig. 1a
Fig. 1b
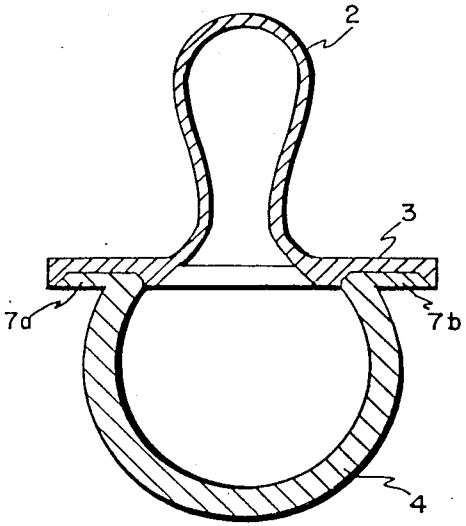
Fig. 2

ONE-PIECE LUMINOUS PACIFIER

This invention relates to means for aiding the teething, tranquilizing and pacifying of infants and small children.

BACKGROUND OF THE INVENTION

Means, commonly known as pacifiers, are used in the field of pediatrics to tranquilize small children and to give them a feeling of security. These devices also offer therapeutic advantages in that they massage the gums of a child and thereby assist in the cutting of teeth.

As set forth in U.S. Pat. No. 3,186,411, to William D. Skidmore, (hereafter "Skidmore") a problem is encountered by parents of small children who use pacifiers. During the night, as, or after, the child falls asleep, the pacifier will fall from the child's mouth. Thereafter the child may have a desire to such or chew on the pacifier. However, since the room in which the child is bedded is normally dark the child cannot easily find the pacifier. Usually, the child will then cry until a parent, or whoever is taking care of the child, is aroused and comes to the child's crib or bed, locates the pacifier after turning on the lights, and gives it back to the infant. Typically, when the light is turned on, the infant is further wakened due to the light and is then further upset. In addition, if other individuals share the room with the infant, they will also be disturbed.

The Skidmore reference teaches the use of a pacifier having a luminous portion, which glows in the dark, to enable an individual checking on a child in a darkened room to locate the pacifier without turning on the room lights. It also enables the child to locate the pacifier without the use of lighting means other than the glow of the pacifier.

However, the pacifier of the Skidmore reference suffers from several disadvantages. The pacifier is composed of several parts, permitting a child to separate the various units and possibly swallow them. Thus, the Skidmore type pacifier is unsatisfactory in that it may be unsafe. Also, the construction of the Skidmore pacifier is such that a glowing element in the sucking portion of the pacifier may be placed in the child's mouth. Although the glowing material may not be toxic, placing a glowing object in the mouth of an infant is thought to be psychologically objectionable to parents, and other potential purchasers and users.

SUMMARY OF THE INVENTION

Accordingly, a pacifier embodying the invention includes a non-luminous nipple formed on, or wedged against, a non-luminous surface or side of a shield. A luminous ring (or handle) is formed on the other surface or side of the shield whereby the shield prevents direct contact between a person sucking on the nipple and the luminous ring (or handle). In one type of pacifier embodying the invention, the nipple is formed as part of the shield and the ring (or handle) is molded, or fused, to the shield whereby essentially a one-piece pacifier is formed. The nipple, shield and ring form a unitary piece which is too large to be swallowed by an infant. The luminous handle is typically too large to be comfortably placed on the child's mouth, whereby, normally, only the non-luminous nipple, intended for sucking, will be placed in the child's mouth and the nipple is separated from the luminous ring by the non-luminous shield.

Another type of pacifier embodying the invention includes a "split-shield". That is, the shield is comprised of two flat, relatively thin, plastic discs attached, or fused, to each other, with one disc being formed of luminous material and the other disc being formed of non-luminous material. The non-luminous nipple is mounted, or formed, on the surface of the non-luminous disc and a luminous handle is mounted, or formed, on the surface of the luminous disc. The "split-shield" enables the pacifier to be seen more easily regardless of its position while preventing direct contact between the non-luminous nipple, normally sucked on by the child, and the luminous handle.

BRIEF DESCRIPTION OF THE DRAWINGS

The invention is best described and understood with reference to the attached drawings, in which FIG. 1A is a cross sectional diagram of a nipple and shield embodying the invention;

FIG. 1B is a cross sectional diagram of a luminous ring embodying the invention;

FIG. 2 is a cross sectional view of a one-piece pacifier embodying the invention;

DETAILED DESCRIPTION OF THE DRAWINGS

Figure 4:
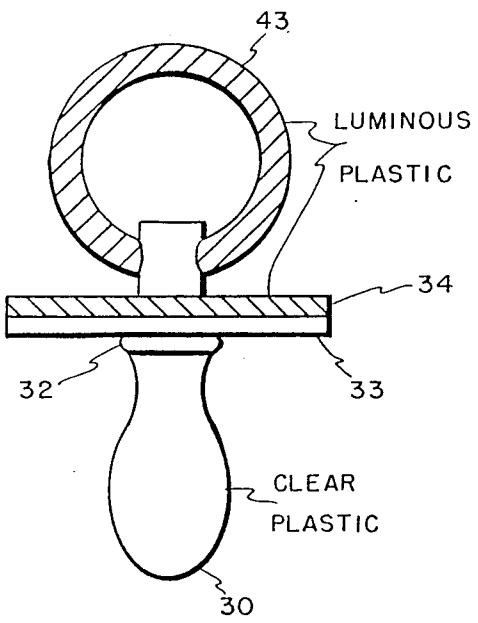
FIG. 4 is a side elevation view of the pacifier of FIG. 3.

Referring to FIG. 1A, there is shown a non-luminous nipple 2 formed as part of, and extending above, a non-luminous shield 3. In one embodiment, shield 3 was made to have a height (or thickness), h1, of approximately 0.15 inches and the nipple was made to extend a height, h2, approximately 1.25 inches above the top of the shield 3. The diameter of the nipple was made approximately 0.6 inches, with the nipple being formed symmetrically about the center of the shield whose diameter was approximately 2 inches. In a particular embodiment, the underside of the shield 3 was slotted or grooved as shown by areas **6*a* and 6*b* to enable flanges 7*a* and 7*b* of a luminous ring 4 shown in FIG. 1B to fit within the slots or grooves of shield 3. The surface areas of the grooves 6*a* and 6*b* and of the flanges 7*a* and 7*b* are designed to provide sufficient contact areas to enable the ring 4 and the shield 3** to be reliably fused together.

The luminous ring 4 as shown in FIG. 1B was made to extend a length, h3, of 1.475 inches below the bottom edges of flanges **7*a* and 7*b*. The diameter, h5, of the ring was made somewhat less than the diameter of the shield, whereby the projection of the non-luminous shield extends over and beyond the glowing ring. Thus the shield functions to separate the luminous portion of the pacifier from the portion normally placed in the child's mouth. The height, h4, of flanges 7*a* and 7*b* may be, typically, in the range of 0.09 to 0.13 inches with their length, in the horizontal direction, being sufficient to fit in slots 6*a* and 6*b***.

In the one embodiment noted above, the nipple 2 and shield 3 with recesses **6*a* and 6*b* were formed from a translucent polyvinyl plastic. The luminous material for ring 4** was formed by first forming a polyvinyl slurry and then introducing a non-toxic phosphorescent pigment into the polyvinyl slurry. The phosphorescent pigment is not toxic, to ensure safety to use, even if ingested.

In a particular manufacturing process, the nipple and shield are formed by the injection of a non-pigmented translucent polyvinyl slurry into one half of a mold having the desired shape to form the nipple and shield. Subsequently, the pigmented polyvinyl slurry is introduced into the other half of the mold having the desired shape to form the ring (handle) and flanges. The pigmented polyvinyl slurry takes the form of the flanged ring shown in FIG. 1B with the flanges being fused, due to the heat of the slurry, to the underside of the shield. When the article (i.e. the pacifier) cools down, the mold is opened and a "one-piece" pacifier is released from the mold whose cross section may be as shown in FIG. 2.

Thus, although the nipple and shield may be formed in a different step, and at a different time, than the luminous handle, the end product is a unitary piece as shown in FIG. 2. Note that the nipple and shield are mounted on top of the luminescent ring with the shield preventing the luminous ring from directly touching a child's face when the child is sucking on the nipple. However, it should be evident that the glow emanating from the ring will radiate throughout the translucent shield, enabling the pacifier to be found even when the pacifier is lying such that the ring portion is facing away from the person trying to find the pacifier.

Figure 3:
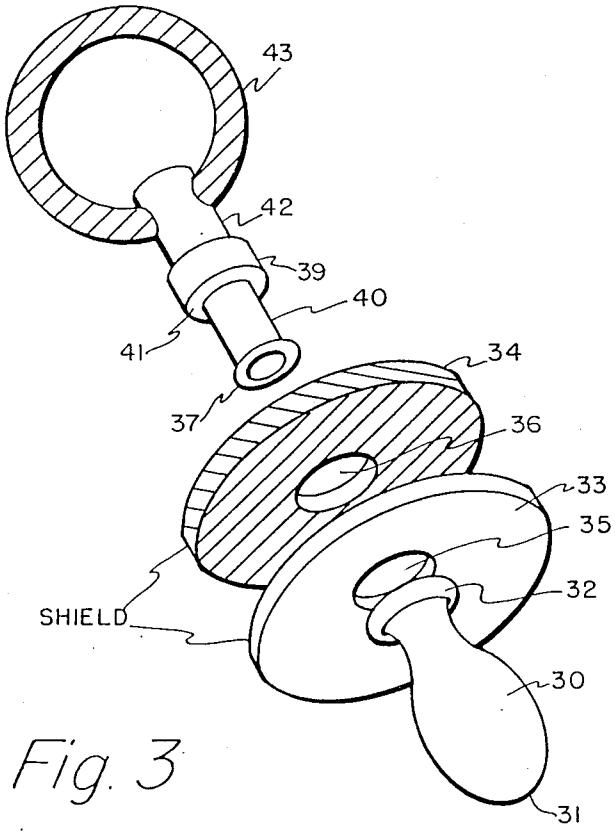
FIG. 3 is an exploded view of another pacifier embodying the invention.

Another type of pacifier embodying the invention may be formed as shown in FIG. 3, and is identified herein as a "split-shield" pacifier.

The nipple 30 has a front portion 31 and a rear portion 32. The rear portion 32 has an enlarged area which bears against a thin, flat, translucent (clear) disc (or washer), 33, with a central opening 35 of such size as to accommodate the bulbous portion 37 of a plug 39. Disc 33 defines one part of the shield separating the nipple from the handle 43. Disc 33, which is translucent, bears against a similarly shaped thin, flat, disc 34 which is luminous. Disc 34 has a central opening 36 of like size as opening 35 to also accommodate the bulbous portion 37 of plug 39. Discs 33 and 34 may be fused, or attached, together in any one of several known methods. Discs 33 and 34 form the "split shield". Disc 33 intended to be in direct contact with nipple 30 and to separate the nipple from the luminous ring 43 is formed of non-luminous material. Disc 34 in contact with the surface of disc 33, away from the nipple is formed of luminous material and enables the pacifier to be seen, more easily, from virtually any angle.

Bulbous portion 37 is formed at one end of shaft 40 at whose other end is formed a shoulder 41. Bulbous portion 37 passes through openings 36 and 35 of discs 34 and 33, respectively, and through rear portion 32 of nipple 30 thereby securing the ring assembly and the shield (discs 33 and 34) to the nipple 30. That is, the discs 33 and 34 sit on shaft 40 being wedged together with the rear end 32 of nipple 30 between the bulbous portion 37 and the shoulder 41. Located behind shoulder 41 is a plug 42 for supporting a handle, or ring, 43 which may be designed to be moveably or fixedly mounted in the plug.

The nipple 30 may be formed of latex rubber or clear silicone and disc 33 may be a hard clear plastic. Disc 34 and handle 43 may be formed using a luminous, pigmented, slurry of the type described above. Discs 33 and 34 are preferably fused together, although they may be mechanically wedged together by means of the nipple plug.

The diameter of disc 33 may be made slightly greater than that of disc 34 to ensure that the non-luminous disc prevents direct contact to the child sucking on the nipple.

The pacifier of FIG. 3 has the side elevation view shown in FIG. 4. Note that the clear plastic shield 33 blocks direct contact between the glowing portion of the pacifier and the nipple while allowing light to pass through and enabling the pacifier to be found easily.

What is claimed is:

1. A pacifier comprising:

a nipple and a shield, and a luminous ring;

said nipple being formed on one side of said shield and as part thereof and said luminous ring being fused to the other side of said shield, said nipple being symmetrically located about the center of the shield, with the shield extending perpendicularly beyond the projection of the nipple and the projection of said luminous ring, said shield including grooves formed on said other side, opposite said nipple, said grooves for the placement therein of flanges flaring out of the top portion of said luminous ring, said flanges for enabling said luminous ring to be fused to the underside of said shield and forming a one-piece pacifier which can be located in the dark, in the absence of an external light source.

2. A pacifier comprising:

a nipple and a shield and a luminous handle, said nipple formed on one side of said shield;

said shield comprising first and second flat, relatively thin, washer shaped discs, said first disc being translucent and said second disc being luminous, said first disc contacting said nipple at one of its surfaces and contacting one surface of said second disc at its other surface; and said luminous handle connected to the other surface of said second disc whereby said first disc prevents a child sucking on the nipple from directly contacting the luminous material in said second disc and said handle while said second, luminous, disc and said luminous handle enable said pacifier to be easily located in the dark.

3. A pacifier comprising:

a nipple;

a shield including first and second flat, relatively thin, washer shaped discs, said first disc being translucent and said second disc being luminous;

said nipple having a top end intended for sucking by a user and a rear enlarged end for securing said nipple to said shield, said nipple being formed to extend, and extending, above one surface of said first disc and the rear end of said nipple being wedged in with said first and second discs for securing said nipple to said shield with the other surface of said first disc contacting one surface of said second disc; and a luminous handle connected to the other surface of said second disc whereby said first disc prevents a child sucking on the nipple from directly contacting the luminous material in said second disc and said handle while said second, luminous, disc and said luminous handle enable said pacifier to be easily located in the dark.

* * * * *